US007607956B2

(12) United States Patent
Lang et al.

(10) Patent No.: US 7,607,956 B2
(45) Date of Patent: Oct. 27, 2009

(54) SPRING FORCE CLAMP

(75) Inventors: Oliver Lang, Bamberg (DE); Peter Ginschel, Pödeldorf (DE); Thomas Brotkorb, Stegaurach (DE); Christian Süss, Strullendorf/Mistendorf (DE)

(73) Assignee: Wieland Electric GmbH, Bamberg (DE)

( * ) Notice: Subject to any disclaimer, the term of this patent is extended or adjusted under 35 U.S.C. 154(b) by 187 days.

(21) Appl. No.: 11/867,747

(22) Filed: Oct. 5, 2007

(65) Prior Publication Data

US 2008/0083097 A1 Apr. 10, 2008

(30) Foreign Application Priority Data

Oct. 5, 2006 (DE) ..... 20 2006 015 363 U

(51) Int. Cl.
*H01R 4/48* (2006.01)

(52) U.S. Cl. ..... 439/835; 439/728

(58) Field of Classification Search ..... 439/835, 439/436, 437, 728, 441
See application file for complete search history.

(56) References Cited

U.S. PATENT DOCUMENTS

| | | | | |
|---|---|---|---|---|
| 6,004,168 | A * | 12/1999 | Fuchs et al. | 439/835 |
| 6,168,479 | B1 * | 1/2001 | Canault et al. | 439/835 |
| 6,350,162 | B1 * | 2/2002 | Despang | 439/835 |
| 6,786,779 | B2 * | 9/2004 | Feldmeier et al. | 439/729 |
| 7,204,727 | B2 * | 4/2007 | Germani | 439/835 |

* cited by examiner

*Primary Examiner*—Hien Vu
(74) *Attorney, Agent, or Firm*—Laurence A. Greenberg; Werner H. Stemer; Ralph E. Locher

(57) ABSTRACT

A spring-force terminal point for an electrical conductor (8) with a clamping spring (1) and with a busbar (2) such that, in a clamping position, the conductor (8) bears against the busbar (2) under the pressure of the clamping spring (1), a tension lever (11) holding, with a latching cam (12), the clamping spring (1) in an opening position, and the tension lever (11) being capable of being triggered by means of a rotary movement so as to move the clamping spring (1) out of its opening position into its clamping position.

7 Claims, 4 Drawing Sheets

SPRING FORCE CLAMP

BACKGROUND OF THE INVENTION

Field of the Invention

BRIEF SUMMARY OF THE INVENTION

The present spring-force terminal point is suitable both for automatic closing and for closing using an operating element. The advantage of the invention consists in the fact that essentially the same component parts can be used for both operating variants. The spring-force terminal point is therefore used for realizing a same-part strategy, which simplifies the storing of the parts and correspondingly reduces the costs involved with storage.

The invention will be explained in more detail with reference to the exemplary embodiments illustrated in the figures, in which:

DESCRIPTION OF THE INVENTION

Figure 1:
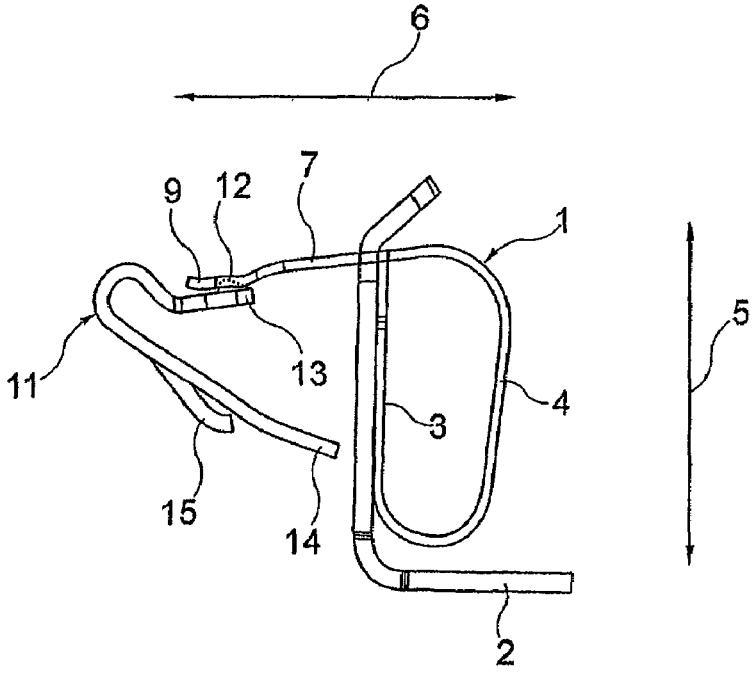
FIG. 1 shows a side view of the spring-force terminal point according to the invention without a housing and without a conductor with a prestressed, open clamping spring.
Figure 1B:
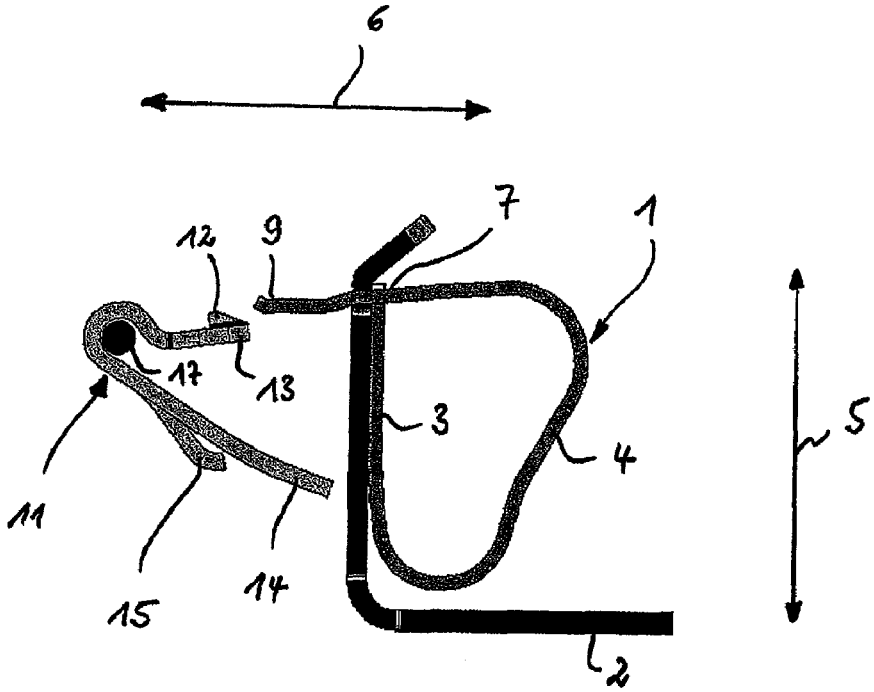
FIG. 1*b* shows a side view of the spring-force terminal point according to the invention without a housing and without a conductor with an untensioned, closed clamping spring.
Figure 2:
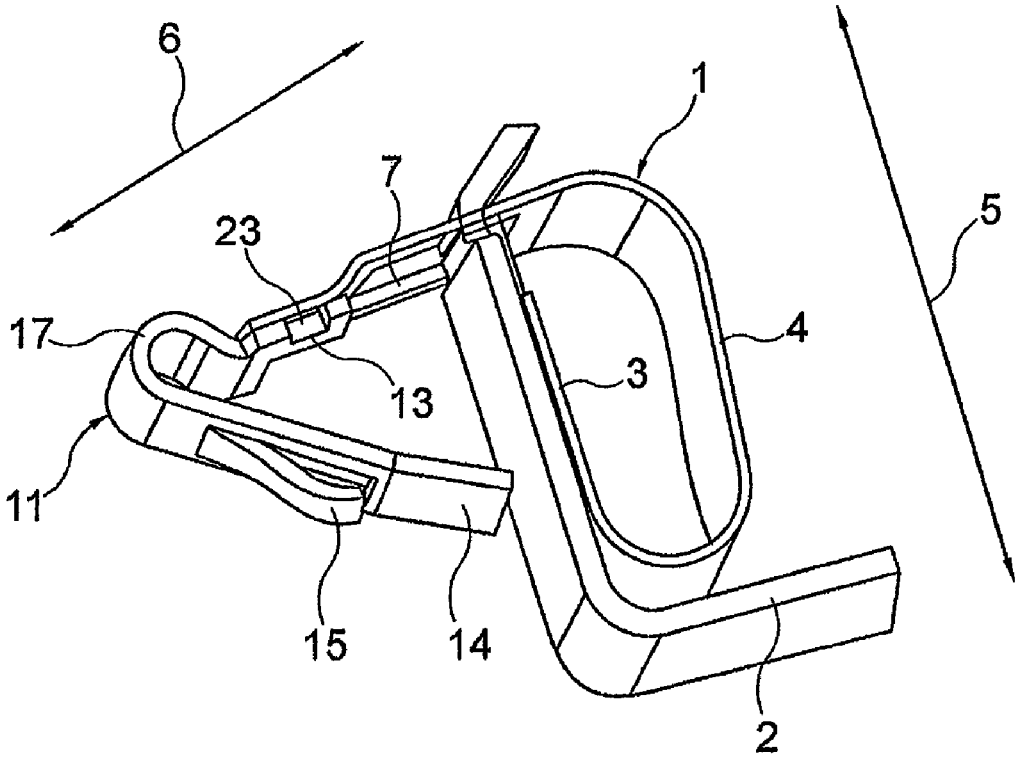
FIG. 2 shows a perspective view according to FIG. 1.
Figure 3:
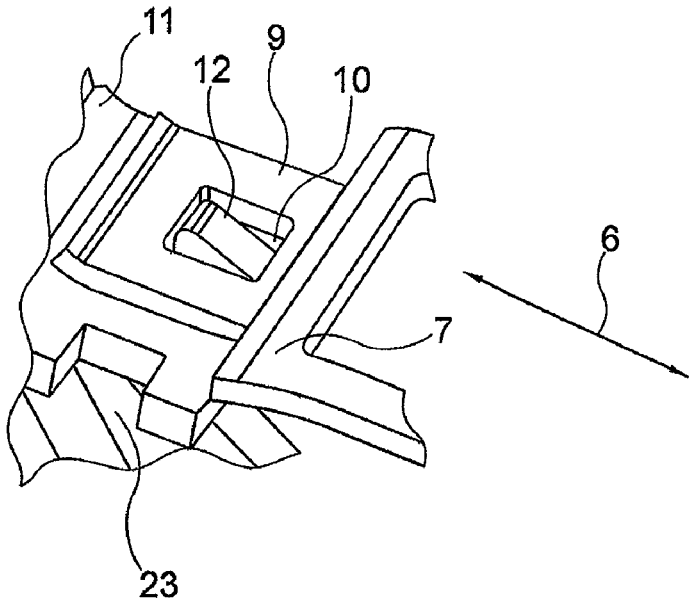
FIG. 3 shows a plan view of the latching cam which has been latched with the clamping spring.

The clamping spring 1 is mounted on the substantially L-shaped busbar 2. The clamping spring fixed limb 3 is fixed to the busbar 2 for this purpose. The L-shaped spring limb 4, which is connected to the clamping spring fixed limb 3, is mounted in a sprung manner on the clamping spring fixed limb 3. The spring limb 4 has a subregion running in the longitudinal direction 5 and a subregion adjoining the latter and running in the transverse direction 6. That subregion of the spring limb 4 of the clamping spring 1 which runs in the transverse direction 6 has an insertion window 7 which passes through the spring limb 4. The busbar 2 passes through the insertion window 7 at the edge. The conductor 8 to be connected can be introduced into the insertion window 7 by the conductor 8 being pushed through the insertion window 7 in the longitudinal direction 5. A retaining lug 9 adjoins the insertion window 7 in the transverse direction 6. For its part, the retaining lug 9 has a latching cutout 10 passing through it. In the opening position of the spring-force terminal point, the latching cam 12 which is formed on the tension lever 11 engages in the latching cutout 10. The tension lever 11 for its part comprises a tensioning limb 13 and a resetting limb 14. The resetting spring 15 is bent out of the resetting limb 14 in the manner of a tab. The tensioning limb 13 and the resetting limb 14 are mounted in the housing 16 in such a way that they are mounted so as to be capable of rotating about the pivot 17 on the tension lever 11.

Figure 4:
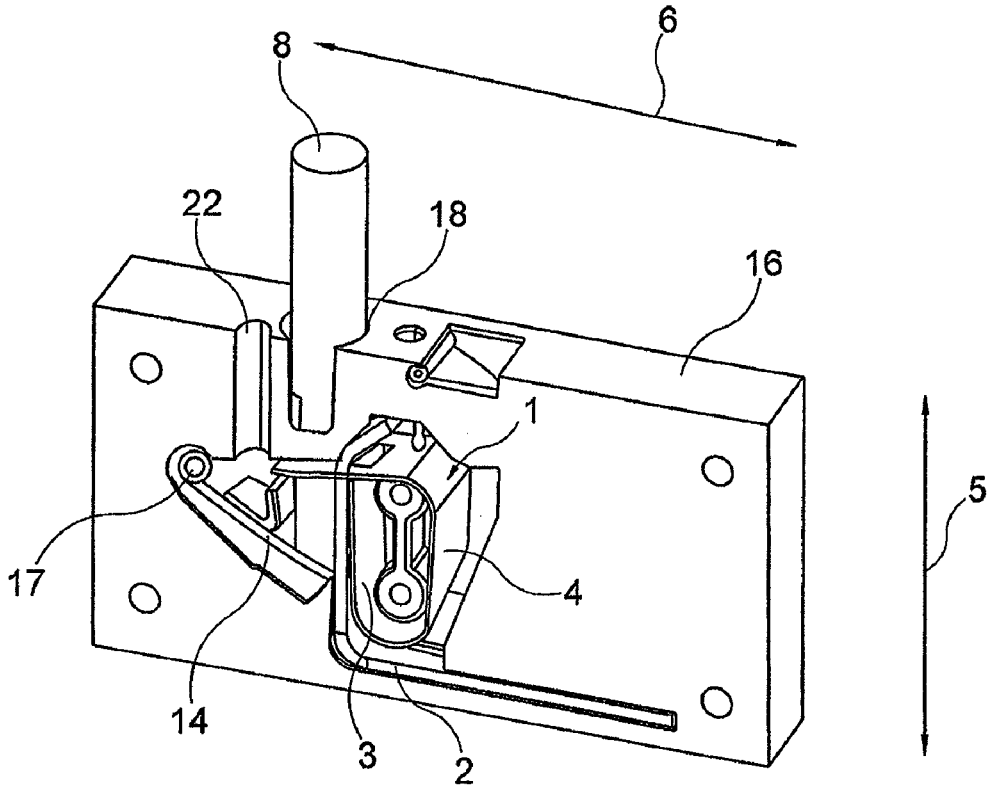
FIG. 4 shows the spring-force terminal point embedded in a housing in its opening position.

FIG. 4 shows the automatically closing embodiment of the spring-force terminal point according to the invention. In order to connect the conductor 8, the conductor 8 is inserted into the housing 16 in the longitudinal direction 5. The housing 16 has an insertion opening 18 corresponding to the insertion window 7 for this purpose. In this case, the conductor 8 is inserted into the insertion opening 18 until that end of the conductor 8 from which the insulation has been stripped meets the resetting limb 14. Under the pressure of the conductor 8, the resetting limb 14 is moved against the resetting spring 15 in the longitudinal direction 5, so that the resetting limb 14 and therefore also in synchronism the tensioning limb 13, i.e. the entire tension lever 11, rotate about the pivot 17 in such a way that the latching cam 12 flies out of the latching cutout 10 and thus releases the spring limb 4. The clamping spring 1 can then be relieved of tension with its spring limb 4 freely in the transverse direction 6, so that the edge of the insertion window 7 which is opposite the busbar 2 in the transverse direction 6 clamps in the conductor 8 between it and the busbar 2. This clamping position, in which the spring limb 4 of the clamping spring 1 has been moved into the clamping position, is illustrated in FIG. 5.

In order to be able to remove the conductor 8 from the spring-force terminal point again, the driver blade 20 of a screwdriver can be inserted into the housing 16 via a dismantling opening 19. The driver blade 20 is used simply to press against the rear side of the spring limb 4 and the spring limb 4 is thus moved towards the tension lever 11 in the transverse direction 6 until the latching cam 12 engages in the latching cutout 10 on the spring limb 4 and thus holds the clamping spring 1 in its opening position, which is illustrated in FIG. 1, FIG. 2, FIG. 4 and FIG. 6. In this opening position, the conductor 8 can be withdrawn from the housing 16 again via the insertion opening 18 very easily. A new conductor can be connected again in the clamping position illustrated in FIG. 5 and fixed by being inserted through the insertion opening 18 and by pressure on the resetting limb 14.

Figure 5:
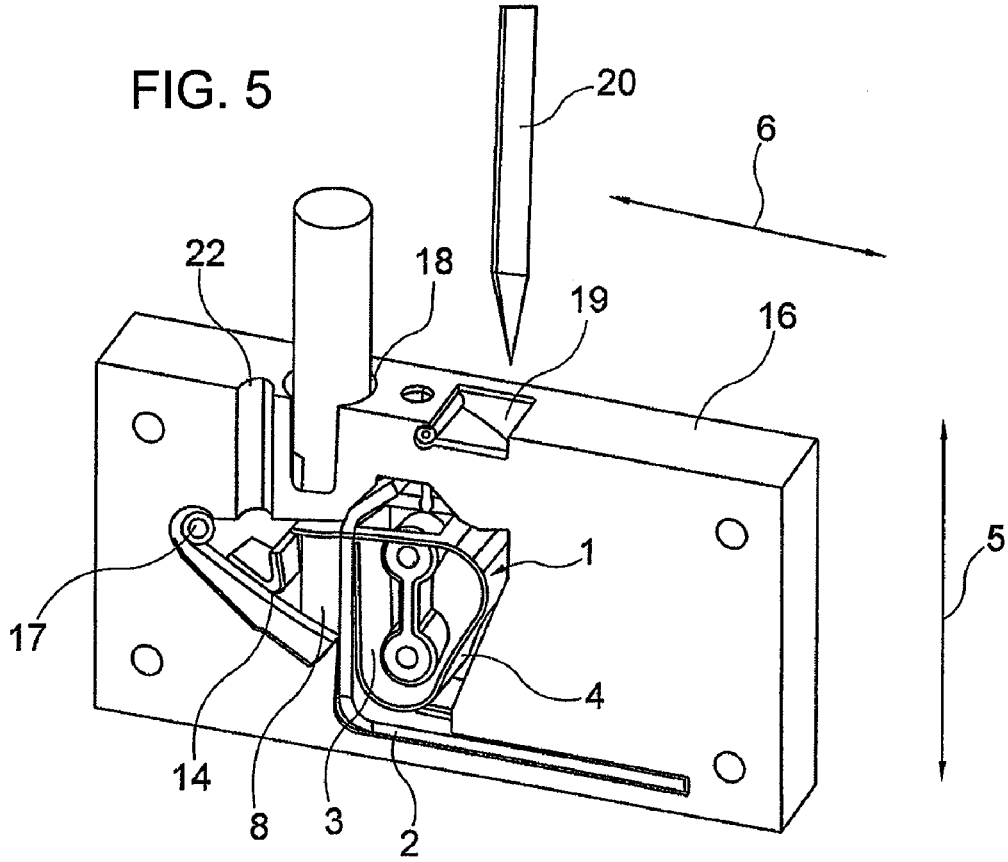
FIG. 5 shows the spring-force terminal point shown in FIG. 4 in its clamping position.
Figure 6:
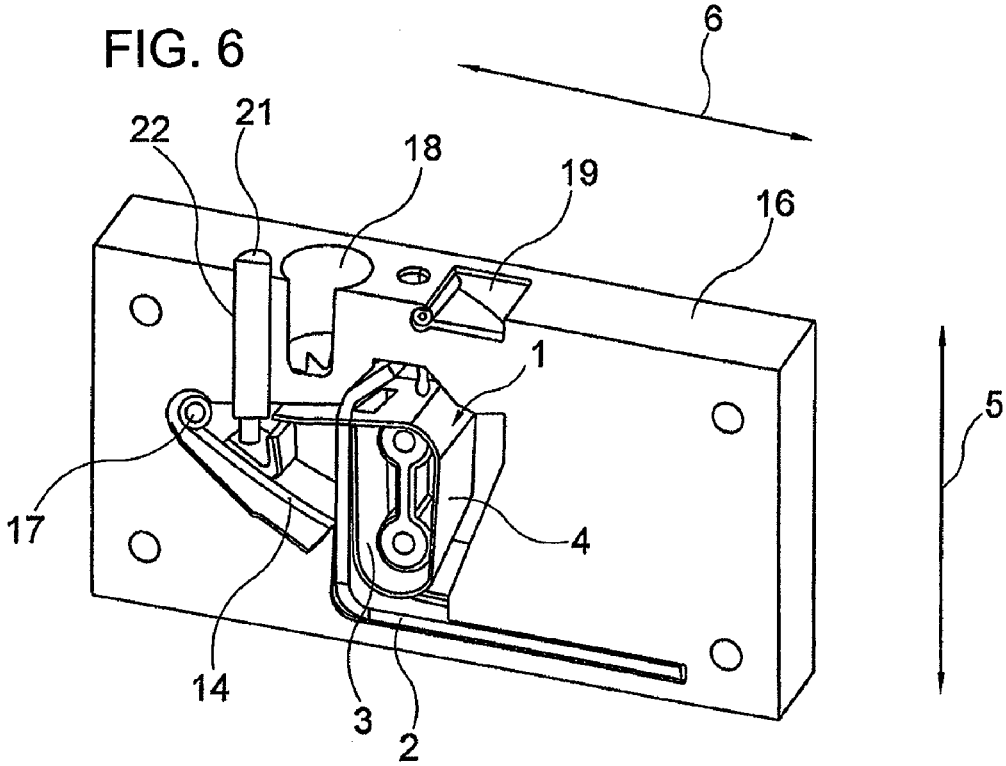
FIG. 6 shows the spring-force terminal point shown in FIG. 4 with an additionally used handle.

FIG. 6 shows a further embodiment of the invention with a handle. In the exemplary embodiment of FIG. 6, the handle is in the form of a pushbutton 21. The pushbutton 21 passes through the housing 16 in the longitudinal direction 5 in a corresponding pushbutton opening 22. For reasons of completeness, mention is made of the fact that the pushbutton opening 22 can always be provided in the housing, i.e. even in those embodiments in which the pushbutton 21 is not used in order to use an identical part for the housing for both embodiments as well. The pushbutton 21 is snapped into retaining grooves 23 formed at the edge on the tensioning limb 13 in the region of the latching cam 12. The pushbutton 21 is therefore mounted on the tensioning limb 13. In order to clamp the conductor 8, the conductor 8 is pushed into the insertion opening 18 in the longitudinal direction 5. As soon as the conductor 8 abuts the rear side of the resetting limb 14, the pushbutton 21 is pressed down in the longitudinal direction 5 and thus the latching cam 12 is again pushed out of the latching cutout 10 in the longitudinal direction 5. Owing to this pushing-out, the tension lever 11 in turn rotates about its pivot 17. The clamping limb 4 of the clamping spring 1 is released and can move into its clamping position (FIG. 5) in the transverse direction 6. In this case, too, the conductor 8 again lies between the edge of the insertion window 7 and the busbar 2. In turn, the release takes place as described above with the aid of a driver blade 20, which is inserted into the housing 16 through the installation opening 19.

While the embodiment shown in FIG. 4 and FIG. 5 is suitable for conductors with a very dimensionally stable cross section, the embodiment shown in FIG. 6 is suitable for conductors with a very unstable shape behavior, in particular for connecting multi-core conductors.

LIST OF REFERENCE SYMBOLS

1 Clamping spring
2 Busbar
3 Clamping spring fixed limb
4 Spring limb
5 Longitudinal direction

6 Transverse direction
7 Insertion window
8 Conductor
9 Retaining lug
10 Latching cutout
11 Tension lever
12 Latching cam
13 Tensioning limb
14 Resetting limb
15 Resetting spring
16 Housing
17 Pivot
18 Insertion opening
19 Dismantling opening
20 Driver blade
21 Pushbutton
22 Pushbutton opening
23 Retaining groove

The invention claimed is:

1. A spring-force clamp for an electrical conductor to be inserted into a conductor housing, comprising:

a clamping spring and a busbar, said busbar being arranged such that, in a clamping position, said clamping spring exerts pressure on the electrical conductor for bearing against said busbar;

a tension lever including a latching cam for holding said clamping spring in an open position, said tension lever being capable of rotary movement for releasing a tension of said clamping spring from holding, so as said clamping spring being moved from an open position into the clamping position for clamping the conductor;

wherein said tension lever is substantially U-shaped and includes a tensioning limb and a resetting limb.

2. The spring-force clamp of claim 1, wherein said tension lever has a resetting spring.

3. The spring-force clamp of claim 1, wherein said resetting limb includes a tab which forms said resetting spring.

4. The spring-force clamp of claim 1 wherein said tensioning limb has a latching cam.

5. The spring-force clamp of claim 4, wherein said tensioning limb and said resetting limb respond to a pressure against said resetting spring to move synchronously in rotary movement such that said latching cam releases said clamping spring from the clamping position.

6. The spring-force clamp of claim 5, wherein the conductor is arranged to press said resetting limb against said resetting spring to release said clamping spring from the clamping position.

7. The spring-force clamp of claim 5, including a pushbutton handle associated with said tensioning limb to cause said resetting spring to release said clamping spring from the clamping position.

* * * * *